US010610003B2

(12) United States Patent
Knoll

(10) Patent No.: US 10,610,003 B2
(45) Date of Patent: Apr. 7, 2020

(54) HOLSTER BEVERAGE HOLDER

(71) Applicant: James Knoll, Bushland, TX (US)

(72) Inventor: James Knoll, Bushland, TX (US)

( * ) Notice: Subject to any disclaimer, the term of this patent is extended or adjusted under 35 U.S.C. 154(b) by 0 days.

(21) Appl. No.: 15/885,721

(22) Filed: Jan. 31, 2018

(65) Prior Publication Data

US 2019/0231057 A1 Aug. 1, 2019

(51) Int. Cl.

| | |
|---|---|
| ***A45F 5/00*** | (2006.01) |
| ***A45F 5/02*** | (2006.01) |
| ***A45F 5/10*** | (2006.01) |
| ***B67B 7/40*** | (2006.01) |
| ***B67B 7/16*** | (2006.01) |

(52) U.S. Cl.

CPC ..... *A45F 5/021* (2013.01); *A45F 5/102* (2013.01); *B67B 7/16* (2013.01); *B67B 7/403* (2013.01); *A45F 2005/002* (2013.01); *A45F 2005/025* (2013.01); *A45F 2200/0583* (2013.01)

(58) Field of Classification Search

CPC .... A45F 5/021; A45F 5/102; A45F 2005/002; A45F 2005/025; A45F 2200/0583; B67B 7/16; B67B 7/403

USPC ..... 224/148.1, 148.7

See application file for complete search history.

(56) References Cited

U.S. PATENT DOCUMENTS 2,088,387 A * 7/1937 Rice, Jr. ..... A47G 23/0241 206/446
3,189,937 A * 6/1965 Sciortino ..... A47G 23/0266 294/33
3,719,305 A * 3/1973 Pressnell ..... A47G 23/0233 215/395
4,088,250 A * 5/1978 Schaefer ..... A45F 3/16 215/395
4,120,073 A * 10/1978 Studebaker ..... A47G 23/0266 16/425
4,602,723 A * 7/1986 DeMars ..... A47G 23/0266 220/742
4,708,273 A * 11/1987 Grant ..... A45F 5/02 220/741
4,773,549 A * 9/1988 Avraham ..... A47G 23/0241 215/396
4,817,810 A * 4/1989 Shull ..... A47G 23/0266 220/741
4,898,297 A * 2/1990 Wheeler ..... A47G 23/0266 220/742
4,993,675 A * 2/1991 Walker ..... A47G 23/0266 220/737
5,013,074 A * 5/1991 Galle ..... A47G 23/0241 215/395
5,040,711 A * 8/1991 Niederhauser ..... A01D 75/008 224/401
5,054,638 A * 10/1991 Rose ..... A47G 23/0266 206/37.1
5,056,696 A * 10/1991 Lahr ..... A45F 5/02 224/148.4
5,232,137 A * 8/1993 Devine ..... A45F 5/02 222/175

(Continued)

*Primary Examiner* — Peter N Helvey
(74) *Attorney, Agent, or Firm* — Shannon Warren

(57) ABSTRACT

A beverage holder for holding a beverage and selectively attaching to a belt of an user. Said beverage holder comprising a beverage containment, and a clipping assembly. Said beverage holder is configured to selectively hold said beverage. Said clipping assembly is configured to selectively attach to said belt of said user.

19 Claims, 12 Drawing Sheets

(56) References Cited

U.S. PATENT DOCUMENTS 5,285,940 A * 2/1994 Goulter ..... A45F 5/00 108/43
5,297,318 A * 3/1994 Adolphson ..... A45F 5/02 224/148.4
5,335,954 A * 8/1994 Holub ..... A45F 5/10 215/376
5,390,838 A * 2/1995 Jafarkhani ..... A45F 5/00 224/148.4
5,582,321 A * 12/1996 Urbanczyk ..... A47G 23/0266 220/626
5,996,836 A * 12/1999 Betras ..... A45F 3/16 220/709
6,045,017 A * 4/2000 Connell ..... A45F 5/02 224/148.4
6,260,731 B1 * 7/2001 Cummings ..... A45F 3/16 220/717
6,557,738 B1 * 5/2003 Meintzer ..... A45F 5/00 224/148.7
6,644,612 B2 * 11/2003 Webb ..... A47G 23/0225 248/311.2
6,651,838 B2 * 11/2003 Bissell ..... B65D 23/106 215/395
6,859,943 B1 * 3/2005 Wallace, III ..... A41D 1/088 2/228
D511,653 S * 11/2005 Oas ..... D7/507
7,207,538 B2 * 4/2007 Kent-Fawkes ..... B65D 23/106 215/395
D593,859 S * 6/2009 Barnum ..... D7/622
7,726,499 B2 * 6/2010 Williamson ..... A47G 23/0241 215/396
D643,289 S * 8/2011 Harlan ..... D7/622
8,066,148 B2 * 11/2011 Garahan ..... A45F 5/02 220/737
D674,278 S * 1/2013 Frederiksen ..... D9/455
8,500,076 B2 * 8/2013 Lai ..... A47G 23/0225 224/148.5
8,662,368 B2 * 3/2014 Elliott ..... A45C 11/38 224/236
8,720,756 B2 * 5/2014 Parsons ..... A45F 5/02 224/269
8,905,262 B2 * 12/2014 Shull ..... B65D 51/007 220/737
9,027,807 B2 * 5/2015 Kampas ..... A45F 5/00 224/148.4
9,463,662 B1 * 10/2016 Sotolongo ..... B44D 3/126
D812,989 S * 3/2018 Seiders ..... D7/622
9,956,139 B2 * 5/2018 Hesketh ..... A61J 1/1462
D820,046 S * 6/2018 Seiders ..... D7/533
2005/0236450 A1 * 10/2005 Iannini ..... A45F 3/15 224/577
2005/0258204 A1 * 11/2005 Evans ..... A45F 5/02 224/197
2017/0073113 A1 * 3/2017 Martin ..... B65D 25/2811

* cited by examiner

HOLSTER BEVERAGE HOLDER

CROSS-REFERENCE TO RELATED APPLICATIONS

This application claims benefit to U.S. Patent Application No. 62/216,715 filed on Sep. 10, 2015 and Ser. No. 15/263,317 filed on Sep. 12, 2016.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant

None of the known inventions and patents, taken either singularly or in combination, is seen to describe the instant disclosure as claimed.

BRIEF SUMMARY OF THE INVENTION

A beverage holder for holding a beverage and selectively attaching to a belt of a user. Said beverage holder comprising a beverage containment, and a clipping assembly. Said beverage holder is configured to selectively hold said beverage. Said clipping assembly is configured to selectively attach to said belt of said user.

A beverage holder for holding a beverage and selectively attaching to a belt of a user. Said beverage holder comprising a beverage containment, and a clipping assembly. Said beverage holder is configured to selectively hold said beverage. Said clipping assembly is configured to selectively attach to said belt of said user. Said clipping assembly comprises a belt clip and a button clip adapter. Said belt clip selectively attaches to said button clip adapter by selectively inserting a portion of said button clip adapter into said belt clip and selectively holding a portion of said button clip adapter within said belt clip. Said belt clip comprises a holster and a clip. Said button clip adapter comprises a button and a clip. Said holster is configured to selectively receive said button of said button clip adapter. Said clip is configured to selectively attach to a portion of said beverage containment. Said button is held within said holster of said belt clip. Said clip is configured to selectively attach to said belt of said beverage holder. Thus, said belt clip selectively attaches to said belt, said button clip adapter selectively attaches to said beverage containment, and said beverage containment selectively holds said beverage. Said button clip adapter and said belt clip comprise a rotating axis. Said button clip adapter and said belt clip selectively rotate along said rotating axis by allowing a portion of said button clip adapter to rest within a portion of said belt clip, and rotating said belt clip and said button clip adapter along an axis of those parts which are attached to one another.

A beverage holder for holding a beverage and selectively attaching to a belt of a user. Said beverage holder comprising a beverage containment, and a clipping assembly. Said beverage holder is configured to selectively hold said beverage. Said clipping assembly is configured to selectively attach to said belt of said user. Said beverage containment comprises a base portion, an upper retainer portion and a handle portion. Said base portion and said upper retainer portion are aligned to surround a portion of said beverage and prevent horizontal movement within said beverage containment of said beverage. Said handle portion comprises a first end and a second end. Said first end is attached to said upper retainer portion and said second end is attached to said base portion. Said handle portion is configured to control movement of said beverage containment and said beverage. Said base portion comprises a lower surface and a lower rim portion. Said lower surface provides a base to set a lower portion of said beverage upon. Said lower rim portion holds said lower portion of said beverage within said beverage containment. Said upper retainer portion comprises an upper rim portion in a ring shape. Said upper rim portion surrounds a mid-portion of said beverage to further contain said beverage. Said upper retainer portion and said base portion comprise an internal diameter and an external diameter. Said internal diameter is sufficient to receive a standard diameter for common shapes of said beverage.

DETAILED DESCRIPTION OF THE INVENTION

Figure 1:
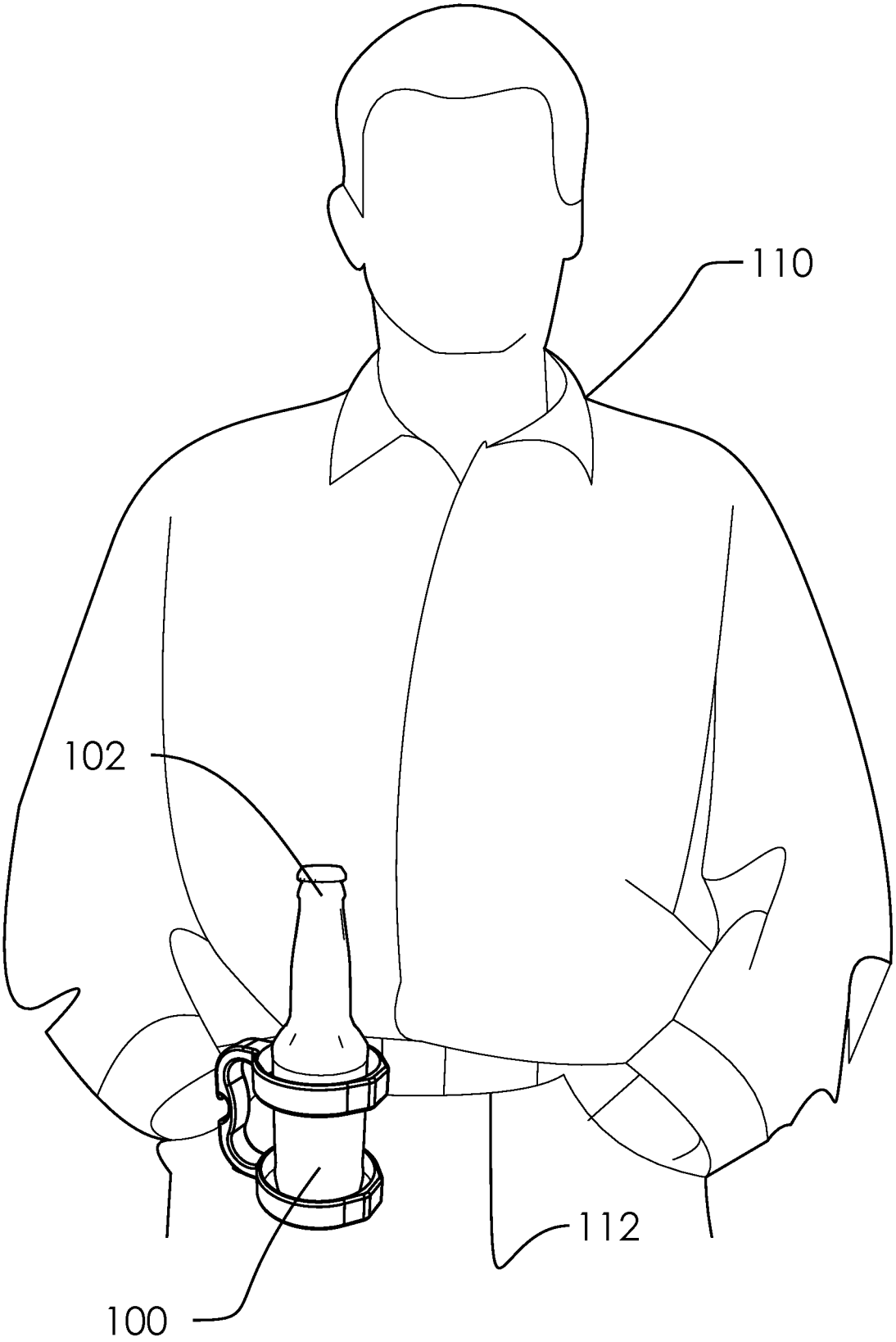
FIG. 1 illustrates a beverage holder 100 attached to user 110.

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

These parts are illustrated in the figures and discussed below:

a beverage holder 100
a beverage 102
a user 110
a belt 112
a beverage containment 200
a can 202
a bottle 203
a base portion 204
an upper retainer portion 206
a handle portion 208
a can tab 224
a cap 226
a lower surface 316
a lower rim portion 318
a bottom surface 320
a central vertical axis 324
a first end 326
a second end 328
a bottle opener 330
a pry tab 332
an upper rim portion 334
an internal diameter 402
a height 404
an external diameter 406
a width 408
an overhang 410
an indention 412
a belt clip 500
a holster 502
a clip 504
a first holster side 506*a*
a second holster side 506*b*
a back portion 520
a passageway 522
a button clip adapter 600
a one or more clip positions 602
a first clip position 602*a*
a second clip position 602*b*
a button 702
a clip 704
a top portion 706
a back portion 708
a bottom portion 710
a lower front portion 712
an upper front portion 714
an angled face 716
a button head 718
a neck portion 720
a one or more configurations 900
a first configuration 900*a*
a second configuration 900*b*
a clipping assembly 1000
a detached configuration 1002*a*
an attached configuration 1002*b*
a rotating axis 1004
a prying configuration 1100

FIG. 1 illustrates a beverage holder 100 attached to user 110.

In one embodiment, said user 110 can comprise said belt 112.

In one embodiment, said beverage holder 100 can attach to said belt 112 for the storage and keeping of a beverage, such as said beverage 102. Meanwhile, said user 110 can keep his hands free.

In one embodiment, said beverage 102 can attach to said user 110 without said belt 112 by clipping on a waistband.

Figure 2A:
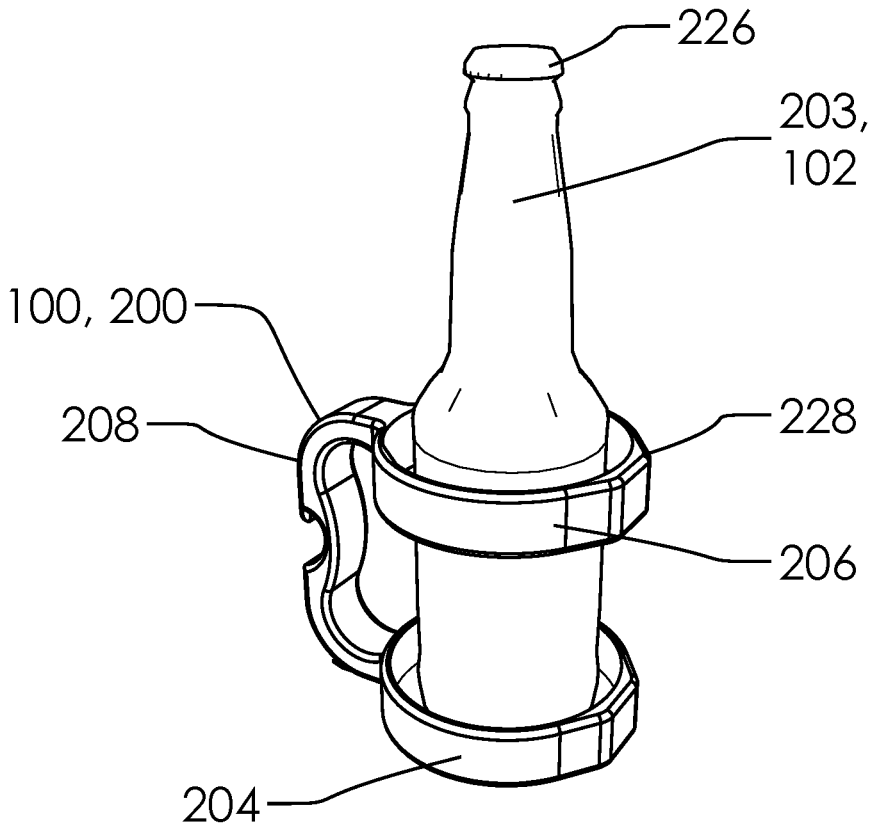
FIG. 2A illustrates a perspective overview of beverage holder 100 with bottle 203.
Figure 2B:
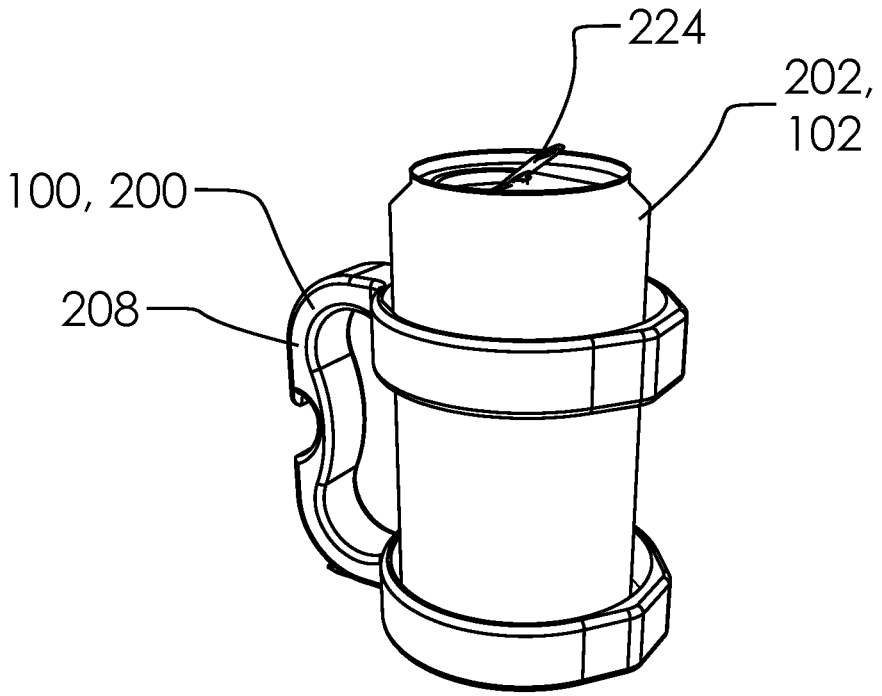
FIG. 2B illustrates a perspective overview of beverage holder 100 with can 202.

FIG. 2A illustrates a perspective overview of beverage holder 100 with bottle 203. FIG. 2B illustrates a perspective overview of beverage holder 100 with can 202.

In one embodiment, said can 202 can comprise said can tab 224.

In one embodiment, said bottle 203 can comprise said cap 226.

In one embodiment, said beverage containment 200 can comprise said base portion 204, said upper retainer portion 206 and said handle portion 208.

In one embodiment, said beverage holder 100 can comprise said beverage containment 200.

In one embodiment, said beverage 102 can comprise said can 202 and said bottle 203.

In one embodiment, said beverage holder 100 can refer to an assembly of parts, as sited herein including said beverage containment 200 configured to. In one embodiment, said beverage containment 200 can be configured to selectively hold beverage 102.

Said beverage containment 200 can comprise a frame or holder for said beverage 102.

In one embodiment, said beverage holder 100 can function like a mug when holding said beverage 102, as illustrated. However, said beverage holder 100 can provide other features as disclosed herein.

Although illustrated as loosely fitting around said beverage 102, said beverage containment 200 can be configured to snuggly fit around said beverage 102. In another embodiment, beverage containment 200 can additionally comprise a springing mechanism, not illustrated or claimed, for holding said beverage 102 within said upper retainer portion 206 and/or said base portion 204, such as done with many car cup holders.

Figure 3A:
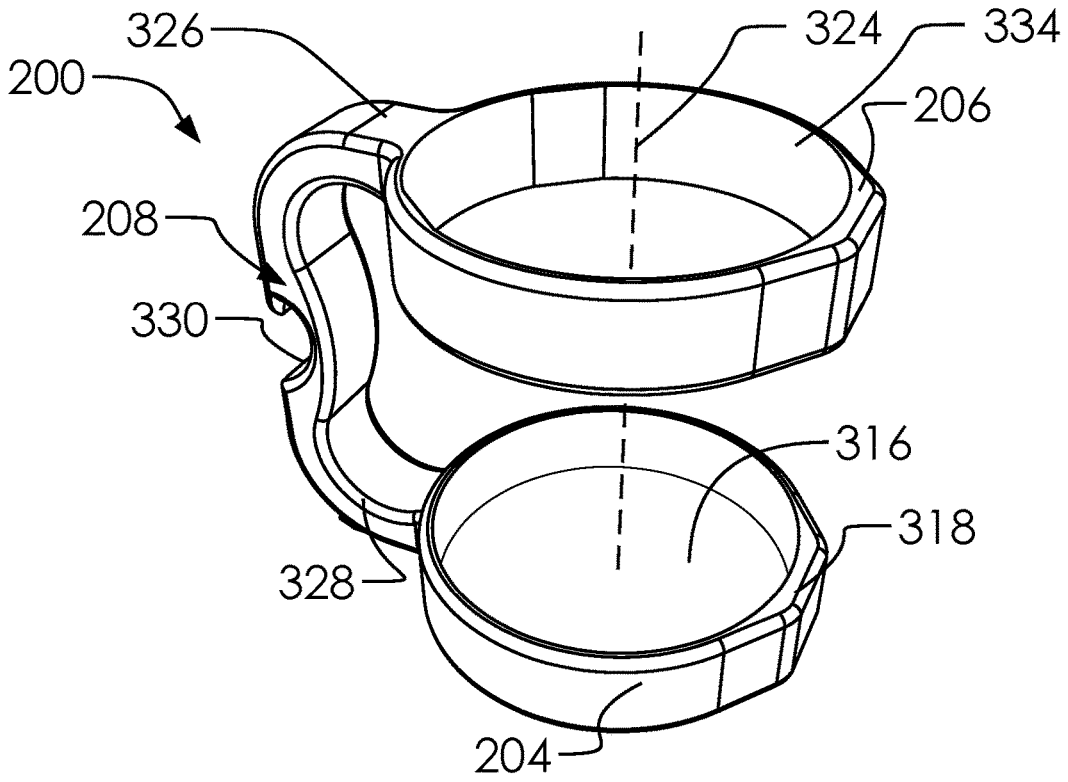
FIG. 3A illustrates a perspective overview of beverage containment 200.
Figure 3B:
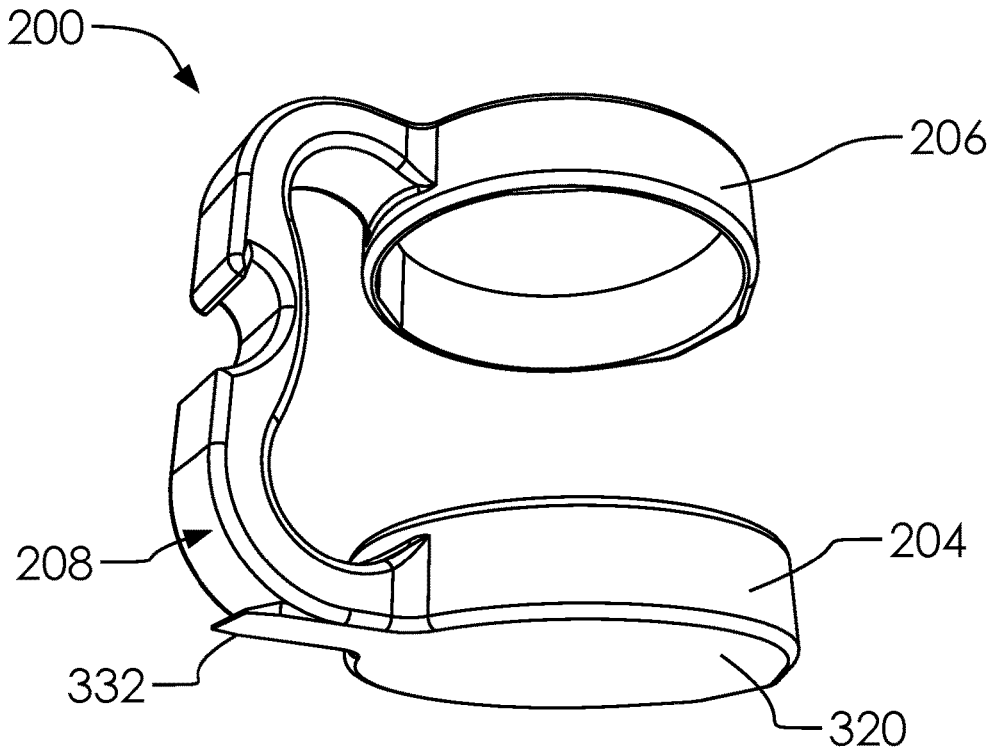
FIG. 3B illustrates a perspective lower view of beverage containment 200.

FIG. 3A illustrates a perspective overview of beverage containment 200. FIG. 3B illustrates a perspective lower view of beverage containment 200.

In one embodiment, said beverage containment 200 can comprise said central vertical axis 324.

In one embodiment, said base portion 204 can comprise said lower surface 316, said lower rim portion 318 and said bottom surface 320.

In one embodiment, said upper retainer portion 206 can comprise said upper rim portion 334.

In one embodiment, said handle portion 208 can comprise said first end 326, said second end 328, said bottle opener 330 and said pry tab 332.

Said beverage containment 200 can comprise a portion of said beverage holder 100 configured to hold said beverage 102. In one embodiment, said beverage containment 200 can be configured to hold said beverage 102 by receiving a portion of said beverage 102 through said upper retainer portion 206, and resting a portion of said beverage 102 on said base portion 204. Accordingly, said upper retainer portion 206 and said base portion 204 can hold said beverage 102 from substantial lateral movement and said beverage 102 can rest upon said base portion 204 so as to prevent it from falling completely through said beverage containment 200.

In one embodiment, said base portion 204 and said upper retainer portion 206 can be attached to one another with said handle portion 208. In this manner, said beverage containment 200 can be formed in the shape of a large mug, with an easy to grip handle (said handle portion 208) at one side and a cold beverage in a central portion.

In one embodiment, said lower surface 316 can be substantially horizontal so as to provide a level surface for receiving said beverage 102. Said lower rim portion 318 can be arranged substantially perpendicular to said lower surface 316, so as to provide a barrier around a circumference of said base portion 204.

Figure 4A:
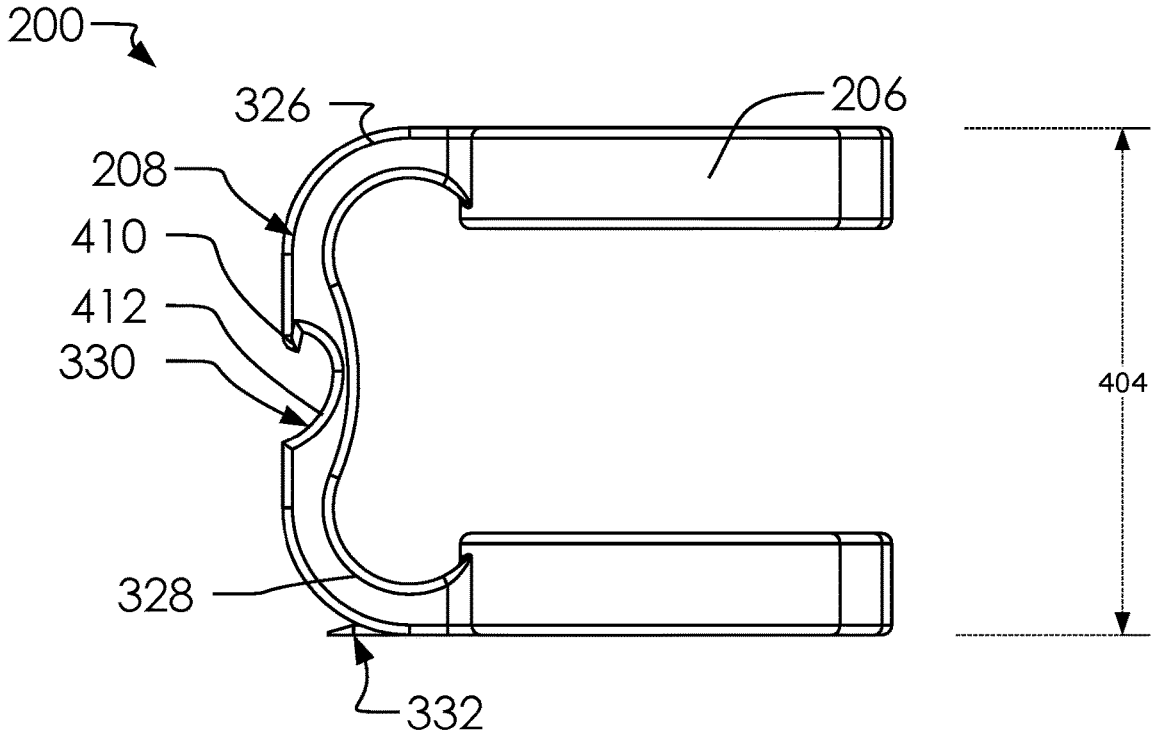
FIG. 4A illustrates elevated front view of beverage containment 200.
Figure 4B:
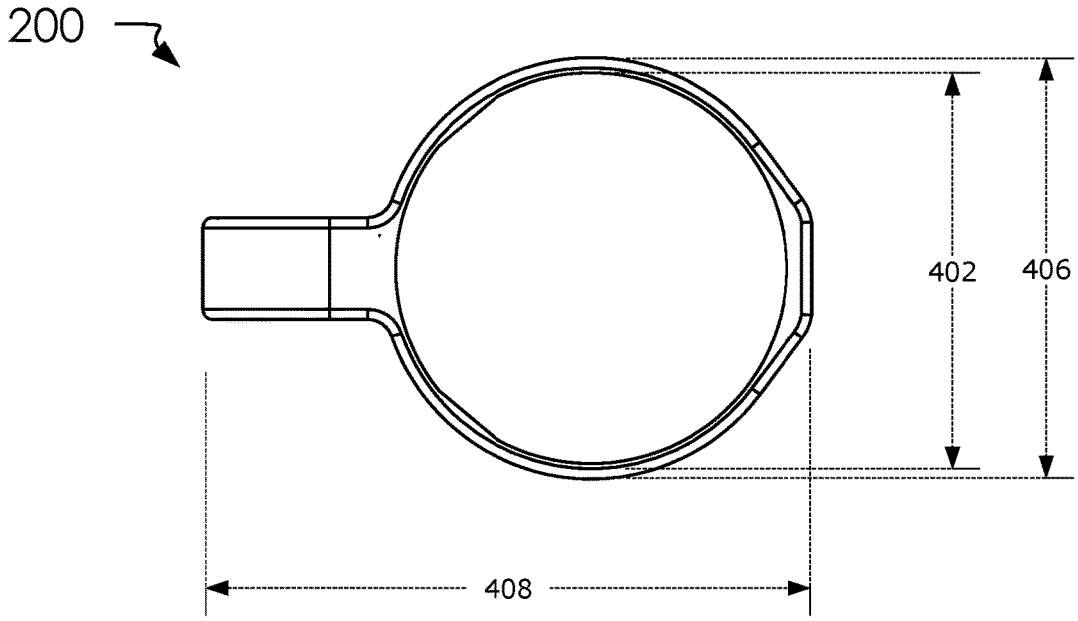
FIG. 4B illustrates elevated top view of beverage containment 200.

FIG. 4A illustrates elevated front view of beverage containment 200. FIG. 4B illustrates elevated top view of beverage containment 200.

In one embodiment, said beverage containment 200 can comprise said height 404, said external diameter 406 and said width 408.

In one embodiment, said base portion 204 can comprise said internal diameter 402 and said external diameter 406.

In one embodiment, said upper retainer portion 206 can comprise said internal diameter 402 and said external diameter 406.

In one embodiment, said bottle opener 330 can comprise said overhang 410 and said indention 412.

In one embodiment, said internal diameter 402 can be spaced so as to receive well-known sizes for beverage 102.

In one embodiment, bottle opener 330 can comprise a gap in a portion of handle portion 208 being between first end 326 and second end 328. In one embodiment, bottle opener 330 can comprise overhang 410 for gripping a portion of beverage 102 and indention 412 can allow a portion of beverage 102 to enter said bottle opener 330.

In one embodiment, pry tab 332 can be at said second end 328. Said pry tab 332 can comprise a metallic or plastic material being strong enough to resist the pressure applied when prying off said cap 226 and/or can tab 224.

Figure 5A:
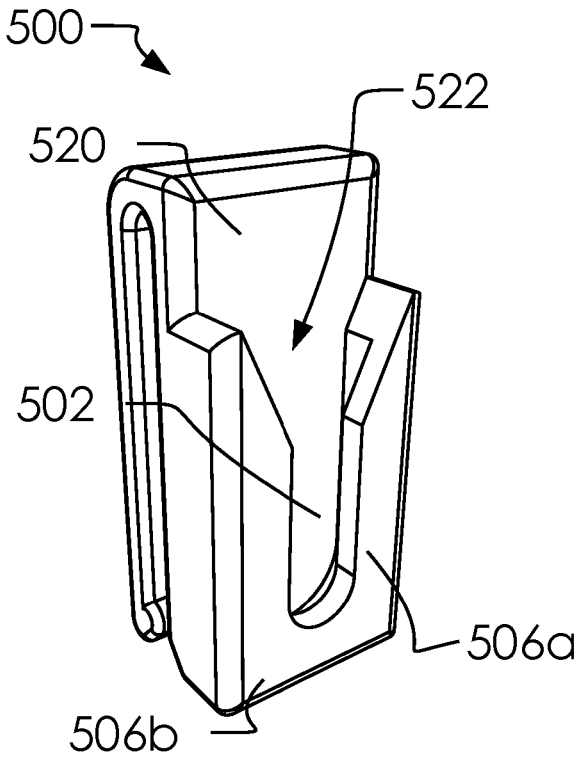
FIG. 5A illustrates perspective overview of belt clip 500.
Figure 5B:
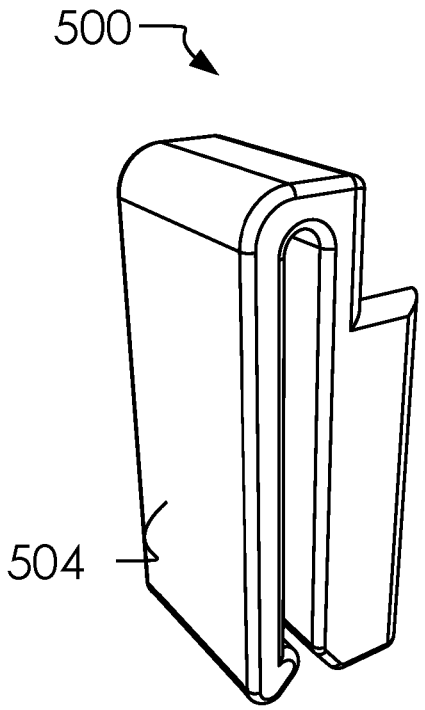
FIG. 5B illustrates perspective backside view of belt clip 500.

FIG. 5A illustrates perspective overview of belt clip 500. FIG. 5B illustrates perspective backside view of belt clip 500.

Figure 5C:
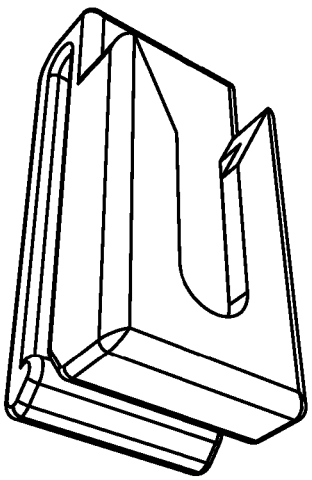
FIG. 5C illustrates perspective lower view of belt clip 500.

FIG. 5C illustrates perspective lower view of belt clip 500.

Figure 5D:
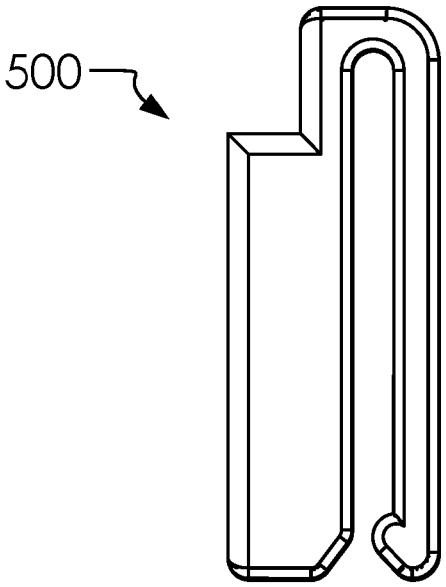
FIG. 5D illustrates elevated side view of belt clip 500.

FIG. 5D illustrates elevated side view of belt clip 500.

In one embodiment, said belt clip 500 can comprise said holster 502, said clip 504, said first holster side 506*a*, said second holster side 506*b*, said back portion 520 and said passageway 522.

In one embodiment, said holster 502 can comprise said first holster side 506*a* and said second holster side 506*b*.

In one embodiment, said beverage holder 100 can comprise said belt clip 500.

Figure 6:
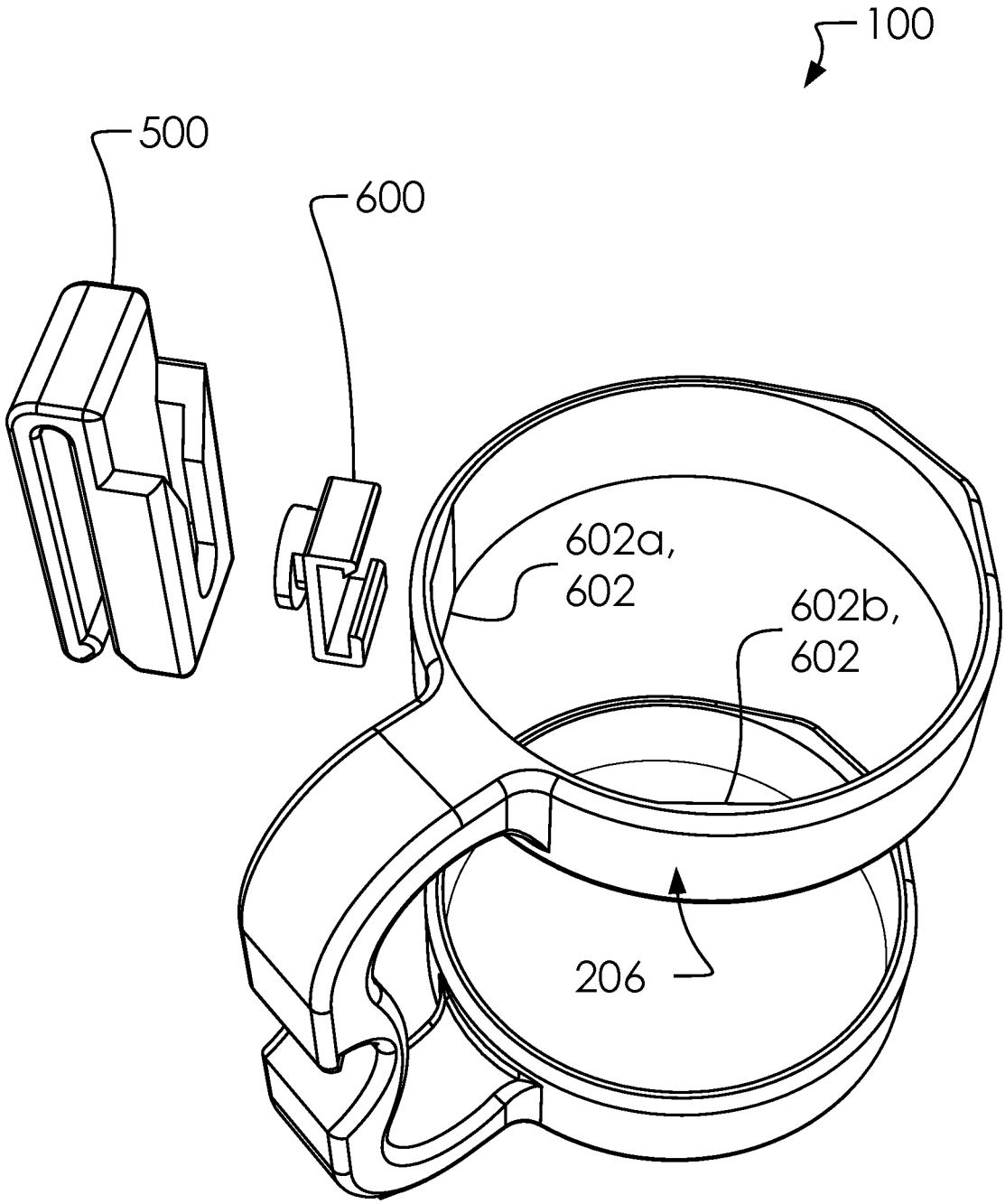
FIG. 6 illustrates perspective overview of beverage holder 100 exploded.

FIG. 6 illustrates perspective overview of beverage holder 100 exploded.

In one embodiment, said one or more clip positions 602 can comprise said first clip position 602*a* and said second clip position 602*b*.

In one embodiment, said beverage holder 100 can comprise said button clip adapter 600, said button clip adapter 600 and said one or more clip positions 602.

In one embodiment, said upper retainer portion 206 can comprise said one or more clip positions 602, said first clip position 602*a* and said second clip position 602*b*.

In one embodiment, said beverage holder 100 can comprise a one or more additional items which can be selectively attached to said beverage containment 200, such as button clip adapter 600 and belt clip 500.

In one embodiment, said button clip adapter 600 can selectively attach to upper retainer portion 206 at any of said one or more clip positions 602.

Figure 7A:
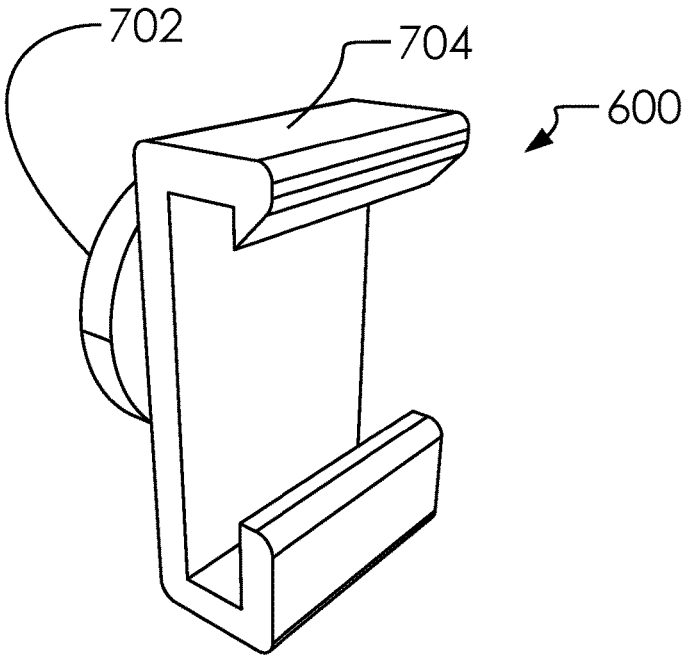
FIG. 7A illustrates perspective overview of button clip adapter 600.
Figure 7B:
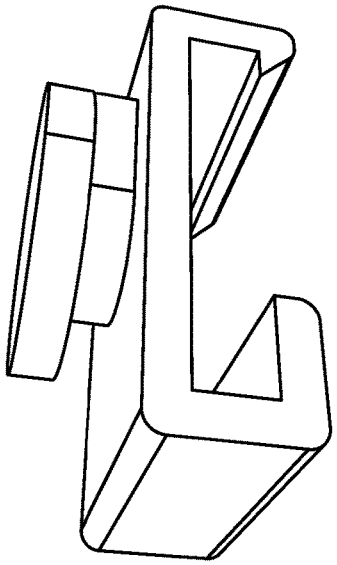
FIG. 7B illustrates perspective side view of button clip adapter 600.
Figure 7C:
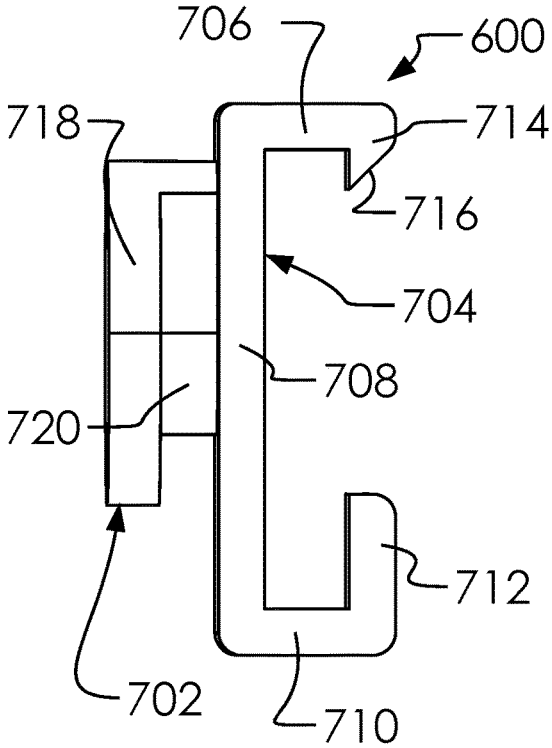
FIG. 7C illustrates elevated side view of button clip adapter 600.
Figure 7D:
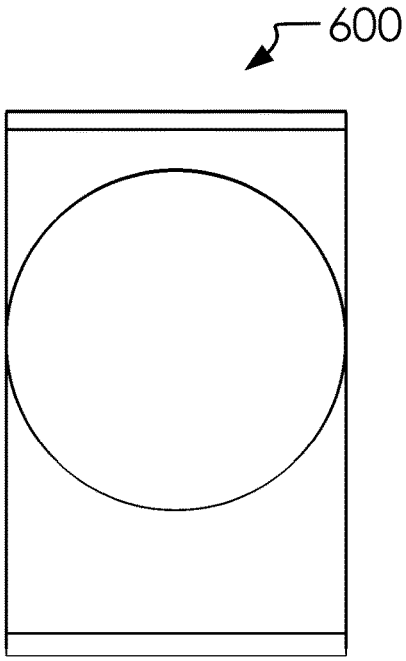
FIG. 7D illustrates elevated front view of button clip adapter 600.
Figure 8:
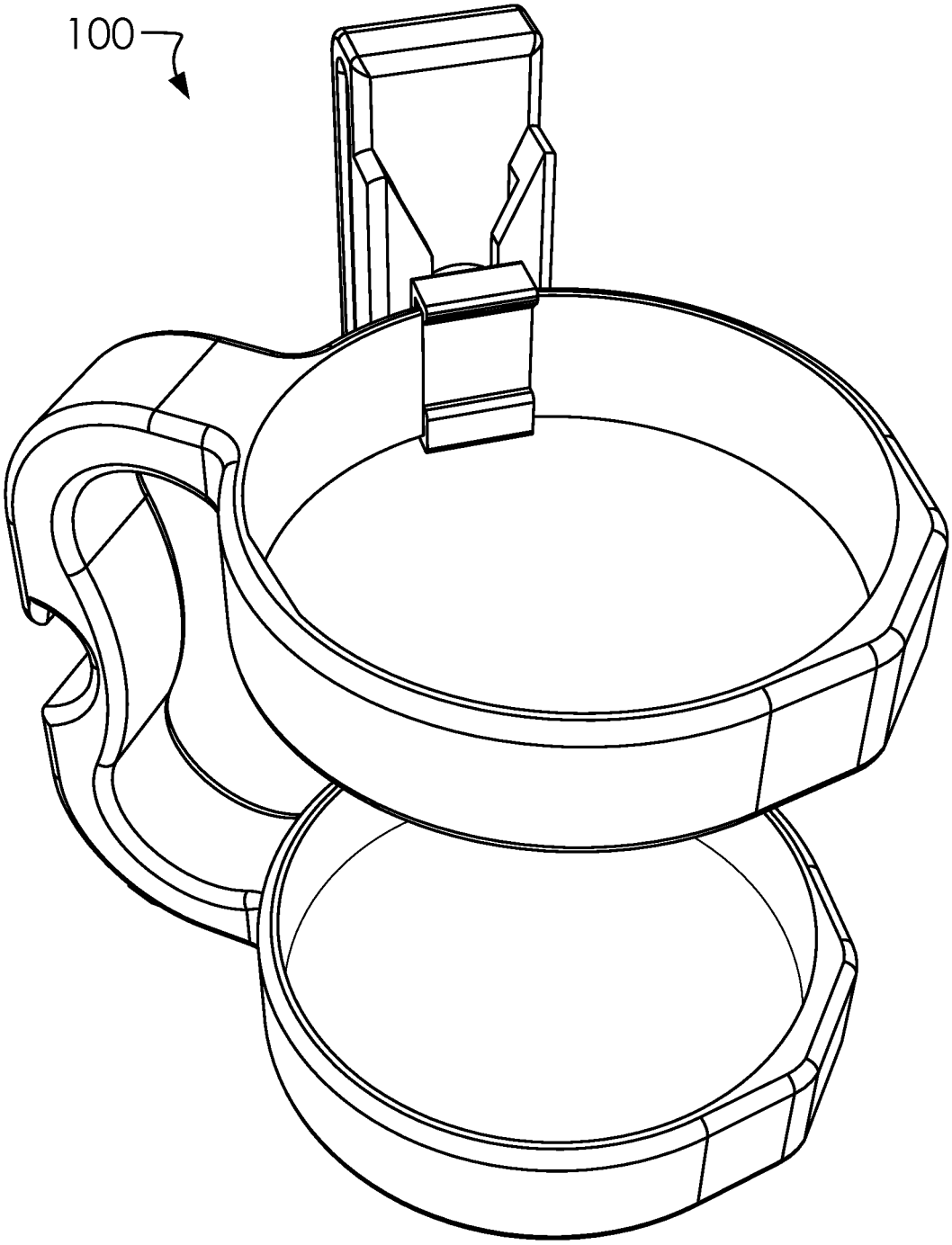
FIG. 8 illustrates perspective overview of beverage holder 100.

FIG. 7A illustrates perspective overview of button clip adapter 600. FIG. 7B illustrates perspective side view of button clip adapter 600. FIG. 7C illustrates elevated side view of button clip adapter 600. FIG. 7D illustrates elevated front view of button clip adapter 600.

In one embodiment, said button 702 can comprise said button head 718, said neck portion 720 and said neck portion 720.

In one embodiment, said clip 704 can comprise said top portion 706, said back portion 708, said bottom portion 710, said lower front portion 712, said upper front portion 714 and said angled face 716.

In one embodiment, said beverage holder 100 can comprise said neck portion 720.

In one embodiment, said button clip adapter 600 can comprise said button 702 and said clip 704.

In one embodiment, button clip adapter 600 can comprise an adapter for selectively attaching belt clip 500 to beverage containment 200. Wherein, button 702 selectively attaches to belt clip 500 and clip 704 selectively attaches to said beverage containment 200.

In one embodiment, clip 704 can comprise a C-shape profile, as illustrated in FIG. 7C. Wherein, clip 704 can derive its shape with upper front portion 714 attached to top portion 706, attached to back portion 708, attached to bottom portion 710, and attached to lower front portion 712 so as to wrap around with a gap between upper front portion 714 and lower front portion 712. In one embodiment, a portion of upper retainer portion 206 can selectively slide through the gap between lower front portion 712 and upper front portion 714.

In one embodiment, button 702 can attach to a portion of back portion 708 so as to provide an attachment point for use with belt clip 500, as discussed below.

In one embodiment, button 702 can comprise neck portion 720 and button head 718; wherein, neck portion 720 is smaller than button head 718 in order to provide a gap for catching a portion of button head 718 in belt clip 500 as discussed below.

Figure 9A:
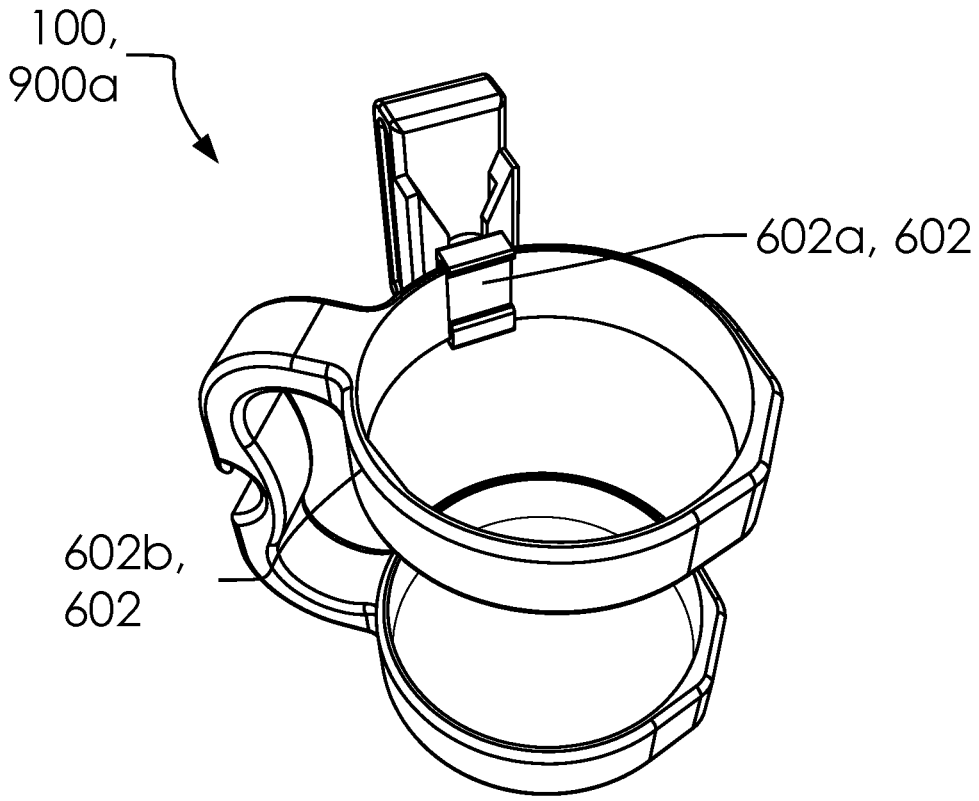
FIG. 9A illustrates perspective overview of first configuration 900*a*.
Figure 9B:
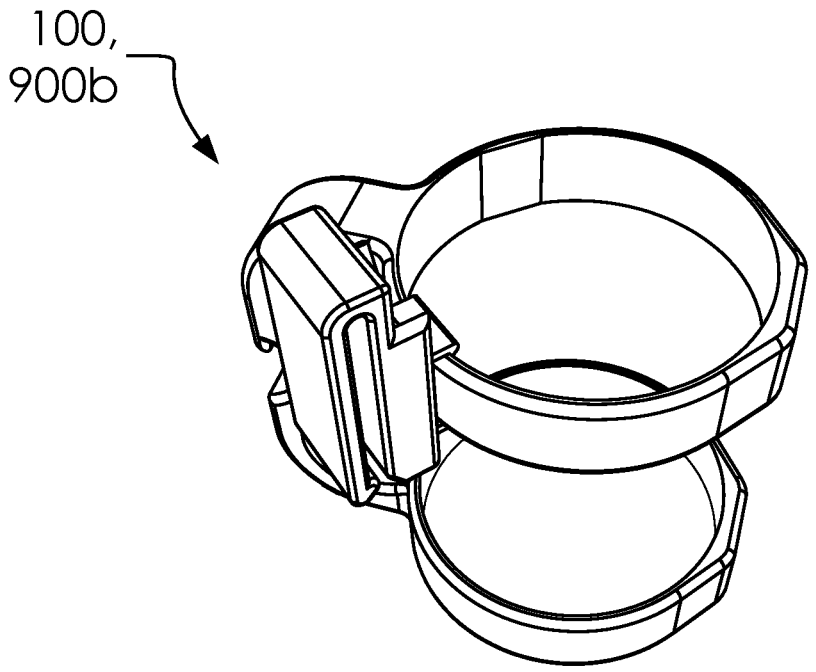
FIG. 9B illustrates perspective back side view of second configuration 900*b*.

FIG. 9A illustrates perspective overview of first configuration 900*a*. FIG. 9B illustrates perspective back side view of second configuration 900*b*.

Figure 10A:
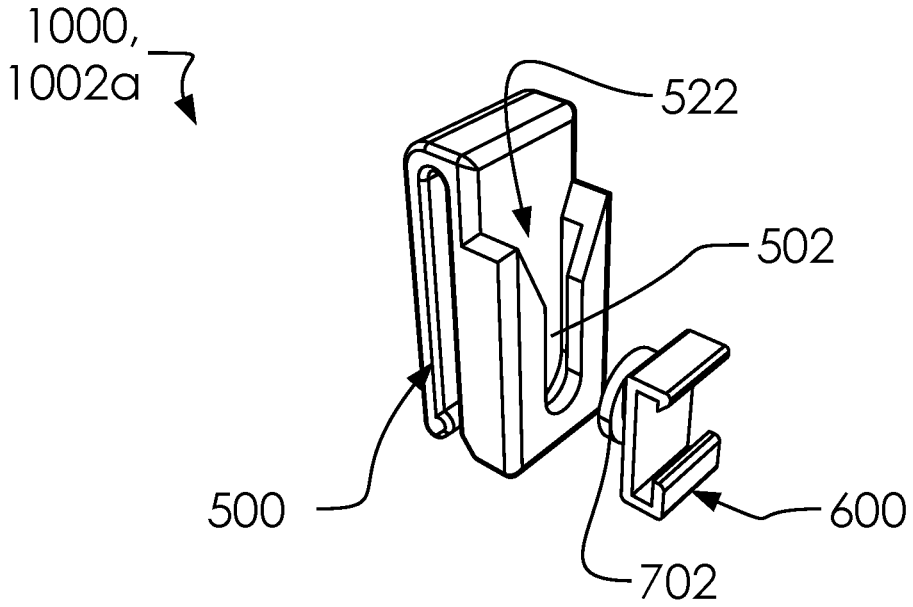
FIG. 10A illustrates perspective overview of detached configuration 1002*a* of clipping assembly 1000.
Figure 10B:
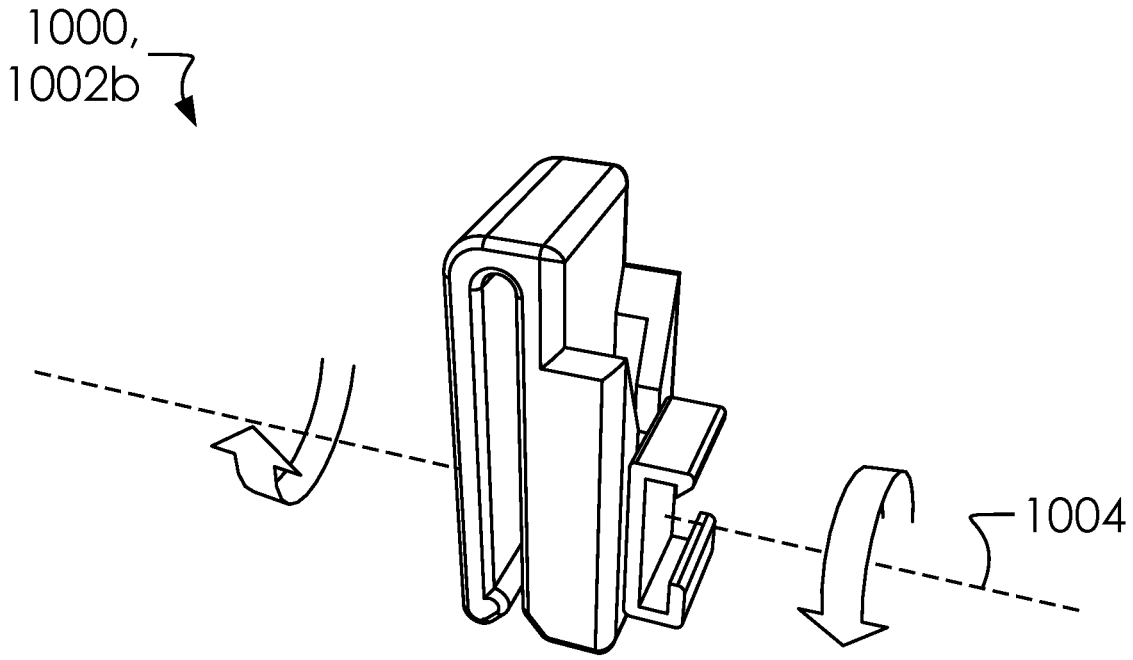
FIG. 10B illustrates perspective overview of attached configuration 1002*b* of clipping assembly 1000.

FIG. 10A illustrates perspective overview of detached configuration 1002*a* of clipping assembly 1000. FIG. 10B illustrates perspective overview of attached configuration 1002*b* of clipping assembly 1000.

Figure 11A:
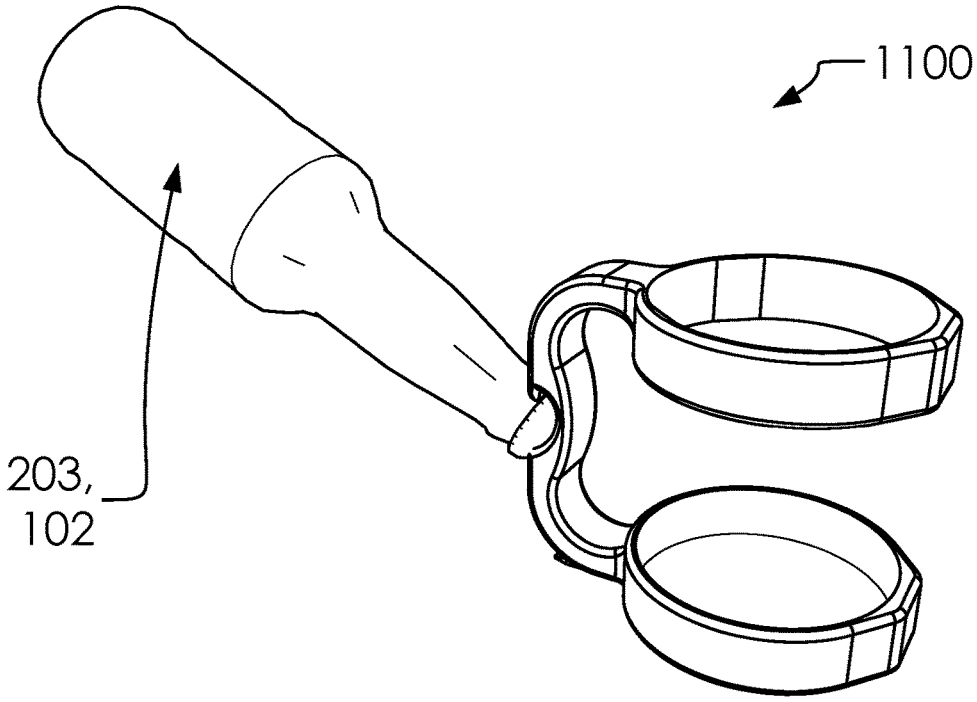
FIG. 11A illustrates perspective overview of prying configuration 1100.
Figure 11B:
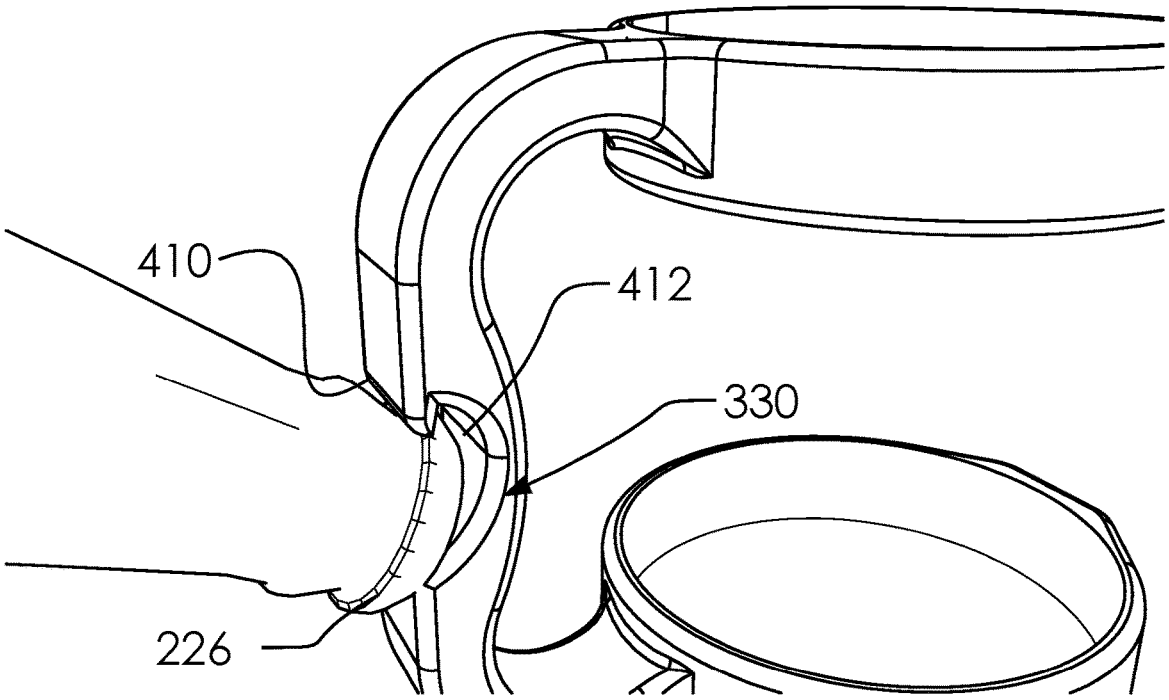
FIG. 11B illustrates perspective overview of prying configuration 1100.

FIG. 11A illustrates perspective overview of prying configuration 1100. FIG. 11B illustrates perspective overview of prying configuration 1100.

Figure 12A:
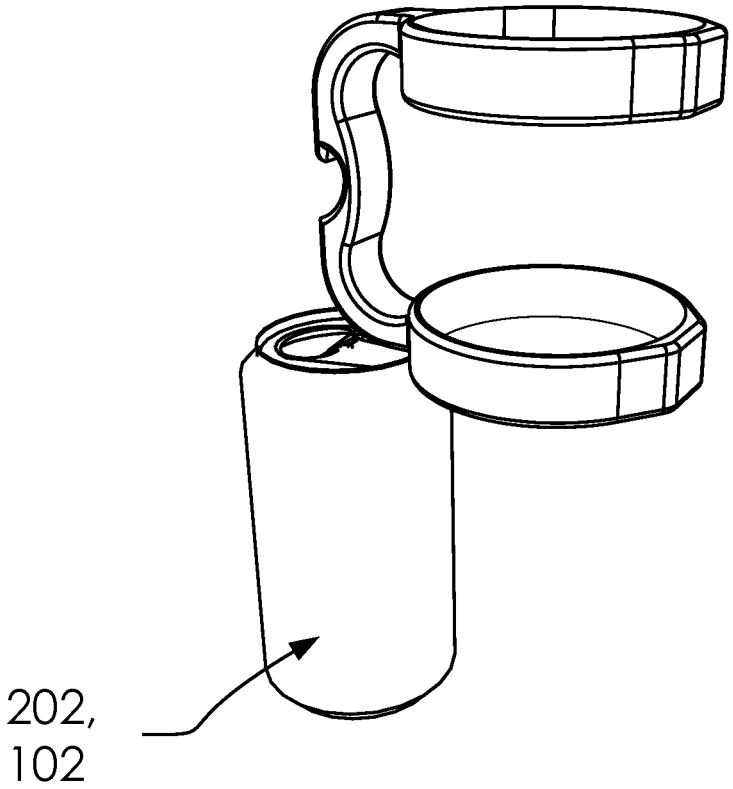
FIG. 12A illustrates perspective overview of beverage holder 100 with can 202.

FIG. 12A illustrates perspective overview of beverage holder 100 with can 202.

Figure 12B:
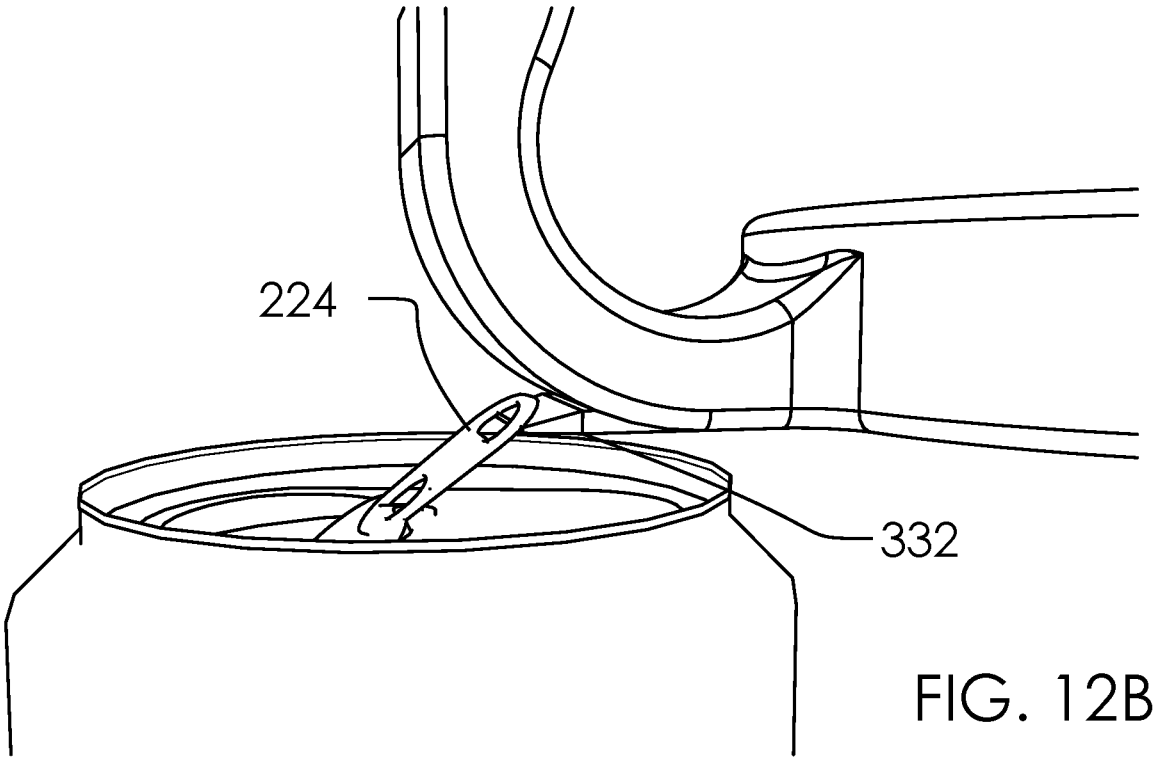
FIG. 12B illustrates perspective overview of beverage holder 100 with can 202.

FIG. 12B illustrates perspective overview of beverage holder 100 with can 202.

The following sentences are included for completeness of this disclosure with reference to the claims.

A beverage holder 100 for holding a beverage 102 and selectively attaching to a belt 112 of a user 110. Said beverage holder 100 comprising a beverage containment 200, and a clipping assembly 1000. Said beverage holder 100 is configured to selectively hold said beverage 102. Said clipping assembly 1000 is configured to selectively attach to said belt 112 of said user 110.

An upper retainer portion 206 comprises a one or more clip positions 602 comprising at least a first clip position 602*a*. Said clipping assembly 1000 is configured to selectively attach to any among said one or more clip positions 602.

Said one or more clip positions 602 comprises said first clip position 602*a* and a second clip position 602*b*. Said first clip position 602*a* and said second clip position 602*b* are located across from one another on said upper retainer portion 206. Said clipping assembly 1000 is configured to selectively attach to said one or more clip positions 602 in order to accommodate left-handed and right-handed use of said beverage holder 100.

Said clipping assembly 1000 comprises a belt clip 500 and a button clip adapter 600. Said belt clip 500 selectively attaches to said button clip adapter 600 by selectively inserting a portion of said button clip adapter 600 into said belt clip 500 and selectively holding a portion of said button clip adapter 600 within said belt clip 500.

Said belt clip 500 comprises a holster 502 and a clip 504. Said button clip adapter 600 comprises a button 702 and a clip 704. Said holster 502 is configured to selectively receive said button 702 of said button clip adapter 600. Said clip 704 is configured to selectively attach to a portion of said beverage containment 200. Said button 702 is held within said holster 502 of said belt clip 500. Said clip 504 is configured to selectively attach to said belt 112 of said beverage holder 100. Thus, said belt clip 500 selectively attaches to said belt 112, said button clip adapter 600 selectively attaches to said beverage containment 200, and said beverage containment 200 selectively holds said beverage 102.

Said button clip adapter 600 and said belt clip 500 comprise a rotating axis 1004. Said button clip adapter 600 and said belt clip 500 selectively rotate along said rotating axis 1004 by allowing a portion of said button clip adapter 600 to rest within a portion of said belt clip 500, and rotating said belt clip 500 and said button clip adapter 600 along an axis of those parts which are attached to one another.

Said button 702 comprises a button head 718 and a neck portion 720. Said neck portion 720 is smaller than said button head 718 in order to provide a gap for catching a portion of said button head 718 in said belt clip 500.

Said button clip adapter 600 comprises said button 702 and said clip 704. Said clip 704 is configured to selectively attach to an upper rim portion 334 of an upper retainer portion 206 by clamping around a portion of said upper rim portion 334. Said clip 704 comprises a C-shape comprising an angled face 716, a top portion 706, a back portion 708, a bottom portion 710 and a lower front portion 712. Said clip 704 derives its shape with an upper front portion 714 attached to said top portion 706, said top portion 706 attached to said back portion 708, said back portion 708 attached to said bottom portion 710, and said bottom portion 710 attached to said lower front portion 712, so as to wrap around with a gap between said upper front portion 714 and said lower front portion 712. A portion of said upper retainer portion 206 selectively slides through said gap between said lower front portion 712 and said upper front portion 714.

Said belt clip 500 further comprises 520, a passageway 522 a first holster side 506*a* and a second holster side 506*b*. Said button 702 selectively slides into and out of said passageway 522. Said passageway 522 is defined by a back portion 520 at a back side, said first holster side 506*a* and said second holster side 506*b* on either side and in front of a portion of said button 702. Said button clip adapter 600 is selectively held inside of said passageway 522 by gravity pulling said button clip adapter 600 into said belt clip 500 within said passageway 522.

Said beverage containment 200 comprises a base portion 204, an upper retainer portion 206 and a handle portion 208. Said base portion 204 and said upper retainer portion 206 are aligned to surround a portion of said beverage 102 and prevent horizontal movement within said beverage containment 200 of said beverage 102. Said handle portion 208 comprises a first end 326 and a second end 328. Said first end 326 is attached to said upper retainer portion 206 and said second end 328 is attached to said base portion 204. Said handle portion 208 is configured to control movement of said beverage containment 200 and said beverage 102.

Said handle portion 208 comprises a pry tab 332 at said second end 328 of said handle portion 208. Said beverage 102 comprises either a can tab 224 or a cap 226. Said pry tab 332 is configured to pry a portion of said beverage 102 open by inserting a portion of said beverage 102 into said pry tab 332 and pulling on said 224 or said cap 226.

Said can tab 224 of said beverage 102 is configured to be pried open with said pry tab 332.

Said handle portion 208 comprises a bottle opener 330 between said first end 326 and said second end 328. Said bottle opener 330 comprises an overhang 410 and an indention 412. Said beverage 102 comprises either a can tab 224 or a cap 226. Said bottle opener 330 is configured to pry a portion of said beverage 102 open by inserting a portion of said beverage 102 into said bottle opener 330 and pulling on said 224 or said cap 226.

Said overhang 410 is configured to open said cap 226 of said beverage 102 by inserting said cap 226 into said indention 412, pressing a portion of said cap 226 against said overhang 410 and pressing another portion of said cap 226 into said indention 412.

Said base portion 204 comprises a lower surface 316 and a lower rim portion 318. Said lower surface 316 provides a base to set a lower portion of said beverage 102 upon. Said lower rim portion 318 holds said lower portion of said beverage 102 within said beverage containment 200. Said upper retainer portion 206 comprises an upper rim portion 334 in a ring shape. Said upper rim portion 334 surrounds a mid-portion of said beverage 102 to further contain said beverage 102.

Said upper retainer portion 206 and said base portion 204 comprise an internal diameter 402 and an external diameter 406. Said internal diameter 402 is sufficient to receive a standard diameter for common shapes of said beverage 102.

Said beverage containment 200 further comprises a central vertical axis 324 being aligned vertically along an axis between said upper retainer portion 206 and said base portion 204. Said beverage 102 can be inserted into said beverage containment 200 by sliding a portion of said beverage 102 through said upper retainer portion 206 along said central vertical axis 324 and setting a portion of said beverage containment 200 on said lower surface 316 of said base portion 204.

Said upper rim portion 334 and said lower rim portion 318 are attached to one another said handle portion 208. A beverage holder 100 for holding a beverage 102 and selectively attaching to a belt 112 of a user 110.

Said beverage holder 100 comprising a beverage containment 200, and a clipping assembly 1000. Said beverage holder 100 is configured to selectively hold said beverage 102. Said clipping assembly 1000 is configured to selectively attach to said belt 112 of said user 110. Said clipping assembly 1000 comprises a belt clip 500 and a button clip adapter 600. Said belt clip 500 selectively attaches to said button clip adapter 600 by selectively inserting a portion of said button clip adapter 600 into said belt clip 500 and selectively holding a portion of said button clip adapter 600 within said belt clip 500. Said belt clip 500 comprises a holster 502 and a clip 504. Said button clip adapter 600 comprises a button 702 and a clip 704. Said holster 502 is configured to selectively receive said button 702 of said button clip adapter 600. Said clip 704 is configured to selectively attach to a portion of said beverage containment 200. Said button 702 is held within said holster 502 of said belt clip 500. Said clip 504 is configured to selectively attach to said belt 112 of said beverage holder 100. Thus, said belt clip 500 selectively attaches to said belt 112, said button clip adapter 600 selectively attaches to said beverage containment 200, and said beverage containment 200 selectively holds said beverage 102. Said button clip adapter 600 and said belt clip 500 comprise a rotating axis 1004. Said button clip adapter 600 and said belt clip 500 selectively rotate along said rotating axis 1004 by allowing a portion of said button clip adapter 600 to rest within a portion of said belt clip 500, and rotating said belt clip 500 and said button clip adapter 600 along an axis of those parts which are attached to one another. A beverage holder 100 for holding a beverage 102 and selectively attaching to a belt 112 of a user 110.

Said beverage holder 100 comprising a beverage containment 200, and a clipping assembly 1000. Said beverage holder 100 is configured to selectively hold said beverage 102. Said clipping assembly 1000 is configured to selectively attach to said belt 112 of said user 110. Said beverage containment 200 comprises a base portion 204, an upper retainer portion 206 and a handle portion 208. Said base portion 204 and said upper retainer portion 206 are aligned to surround a portion of said beverage 102 and prevent horizontal movement within said beverage containment 200 of said beverage 102. Said handle portion 208 comprises a first end 326 and a second end 328. Said first end 326 is attached to said upper retainer portion 206 and said second end 328 is attached to said base portion 204. Said handle portion 208 is configured to control movement of said beverage containment 200 and said beverage 102. Said base portion 204 comprises a lower surface 316 and a lower rim portion 318. Said lower surface 316 provides a base to set a lower portion of said beverage 102 upon. Said lower rim portion 318 holds said lower portion of said beverage 102 within said beverage containment 200. Said upper retainer portion 206 comprises an upper rim portion 334 in a ring shape. Said upper rim portion 334 surrounds a mid-portion of said beverage 102 to further contain said beverage 102. Said upper retainer portion 206 and said base portion 204 comprise an internal diameter 402 and an external diameter 406. Said internal diameter 402 is sufficient to receive a standard diameter for common shapes of said beverage 102.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A beverage holder for holding a beverage and selectively attaching to a belt of a user, wherein:

said beverage holder comprising a beverage containment, and a clipping assembly;

said beverage holder is configured to selectively hold said beverage;

said clipping assembly is configured to selectively attach to said belt of said user;

said beverage containment comprises a base portion, an upper retainer portion and a handle portion;

said base portion and said upper retainer portion are aligned to surround a portion of said beverage and prevent horizontal movement within said beverage containment of said beverage;

said handle portion comprises a first end and a second end;

said first end is attached to said upper retainer portion and said second end is attached to said base portion;

said handle portion is configured to control movement of said beverage containment and said beverage;

said handle portion comprises a bottle opener between said first end and said second end;

said bottle opener comprises an overhang and an indention;

said beverage comprises either a can tab or a cap; and said bottle opener is configured to pry a portion of said beverage open by inserting a portion of said beverage into said bottle opener and pulling on said can tab or said cap.

2. The beverage holder from claim 1, wherein:

an upper retainer portion comprises a one or more clip positions comprising at least a first clip position; and said clipping assembly is configured to selectively attach to any among said one or more clip positions.

3. The beverage holder from claim 2, wherein:

said one or more clip positions comprises said first clip position and a second clip position;

said first clip position and said second clip position are located across from one another on said upper retainer portion; and said clipping assembly is configured to selectively attach to said one or more clip positions to accommodate left-handed and right-handed use of said beverage holder.

4. The beverage holder from claim 1, wherein:
said clipping assembly comprises a belt clip and a button clip adapter; and
said belt clip selectively attaches to said button clip adapter by
selectively inserting a portion of said button clip adapter into said belt clip and
selectively holding a portion of said button clip adapter within said belt clip.

5. The beverage holder from claim 4, wherein:
said belt clip comprises a holster and a clip;
said button clip adapter comprises a button and a clip;
said holster is configured to selectively receive said button of said button clip adapter;
said clip is configured to selectively attach to a portion of said beverage containment;
said button is held within said holster of said belt clip;
said clip is configured to selectively attach to said belt of said beverage holder; and
thus,
said belt clip selectively attaches to said belt,
said button clip adapter selectively attaches to said beverage containment, and
said beverage containment selectively holds said beverage.

6. The beverage holder from claim 5, wherein:
said button clip adapter and said belt clip comprise a rotating axis; and
said button clip adapter and said belt clip selectively rotate along said rotating axis by
allowing a portion of said button clip adapter to rest within a portion of said belt clip, and
rotating said belt clip and said button clip adapter along an axis of those parts which are attached to one another.

7. The beverage holder from claim 5, wherein:
said button comprises a button head and a neck portion; and
said neck portion is smaller than said button head to provide a gap for catching a portion of said button head in said belt clip.

8. The beverage holder from claim 5, wherein:
said button clip adapter comprises said button and said clip;
said clip is configured to selectively attach to an upper rim portion of an upper retainer portion by clamping around a portion of said upper rim portion;
said clip comprises a C-shape comprising an angled face, a top portion, a back portion, a bottom portion and a lower front portion;
said clip derives its shape with
an upper front portion attached to said top portion,
said top portion attached to said back portion,
said back portion attached to said bottom portion, and
said bottom portion attached to said lower front portion,
to wrap around with a gap between said upper front portion and said lower front portion; and
a portion of said upper retainer portion selectively slides through said gap between said lower front portion and said upper front portion.

9. The beverage holder from claim 5, wherein:
said belt clip further comprises said back portion, a passageway a first holster side and a second holster side;
said button selectively slides into and out of said passageway;
said passageway is defined by a back portion at a back side, said first holster side and said second holster side on either side and in front of a portion of said button; and
said button clip adapter is selectively held inside of said passageway by gravity pulling said button clip adapter into said belt clip within said passageway.

10. The beverage holder from claim 1, wherein:
said handle portion comprises a pry tab at said second end of said handle portion;
said beverage comprises either a can tab or a cap; and
said pry tab is configured to pry a portion of said beverage open by inserting a portion of said beverage into said pry tab and pulling on said can tab or said cap.

11. The beverage holder from claim 10, wherein:
said can tab of said beverage is configured to be pried open with said pry tab.

12. The beverage holder from claim 1, wherein:
said overhang is configured to open said cap of said beverage by
inserting said cap into said indention,
pressing a portion of said cap against said overhang and pressing another portion of said cap into said indention.

13. The beverage holder from claim 1, wherein:
said base portion comprises a lower surface and a lower rim portion;
said lower surface provides a base to set a lower portion of said beverage upon;
said lower rim portion holds said lower portion of said beverage within said beverage containment;
said upper retainer portion comprises an upper rim portion in a ring shape; and
said upper rim portion surrounds a mid-portion of said beverage to further contain said beverage.

14. The beverage holder from claim 13, wherein:
said upper retainer portion and said base portion comprise an internal diameter and an external diameter; and
said internal diameter is sufficient to receive a standard diameter for common shapes of said beverage.

15. The beverage holder from claim 13, wherein:
said beverage containment further comprises a central vertical axis being aligned vertically along an axis between said upper retainer portion and said base portion; and
said beverage can be inserted into said beverage containment by sliding a portion of said beverage through said upper retainer portion along said central vertical axis and setting a portion of said beverage containment on said lower surface of said base portion.

16. The beverage holder from claim 13, wherein:
said upper rim portion and said lower rim portion are attached to one another said handle portion.

17. A beverage holder for holding a beverage and selectively attaching to a belt of a user, wherein:
said beverage holder comprising a beverage containment, and a clipping assembly;
said beverage holder is configured to selectively hold said beverage;
said clipping assembly is configured to selectively attach to said belt of said user;
said beverage containment comprises a base portion, an upper retainer portion and a handle portion;
said base portion and said upper retainer portion are aligned to surround a portion of said beverage and prevent horizontal movement within said beverage containment of said beverage;

said handle portion comprises a first end and a second end;

said first end is attached to said upper retainer portion and said second end is attached to said base portion;

said handle portion is configured to control movement of said beverage containment and said beverage;

said handle portion comprises a pry tab at said second end of said handle portion;

said beverage comprises either a can tab or a cap; and said pry tab is configured to pry a portion of said beverage open by inserting a portion of said beverage into said pry tab and pulling on said can tab or said cap.

18. The beverage holder from claim 17, wherein:

an upper retainer portion comprises a one or more clip positions comprising at least a first clip position;

said clipping assembly is configured to selectively attach to any among said one or more clip positions;

said one or more clip positions comprises said first clip position and a second clip position;

said first clip position and said second clip position are located across from one another on said upper retainer portion;

said clipping assembly is configured to selectively attach to said one or more clip positions to accommodate left-handed and right-handed use of said beverage holder;

said clipping assembly comprises a belt clip and a button clip adapter;

said belt clip selectively attaches to said button clip adapter by selectively inserting a portion of said button clip adapter into said belt clip and selectively holding a portion of said button clip adapter within said belt clip;

said belt clip comprises a holster and a clip;

said button clip adapter comprises a button and a clip;

said holster is configured to selectively receive said button of said button clip adapter;

said clip is configured to selectively attach to a portion of said beverage containment;

said button is held within said holster of said belt clip;

said clip is configured to selectively attach to said belt of said beverage holder; and thus, said belt clip selectively attaches to said belt, said button clip adapter selectively attaches to said beverage containment, and said beverage containment selectively holds said beverage.

19. A beverage holder for holding a beverage and selectively attaching to a belt of a user, wherein:

said beverage holder comprising a beverage containment, and a clipping assembly;

said beverage holder is configured to selectively hold said beverage;

said clipping assembly is configured to selectively attach to said belt of said user;

said clipping assembly comprises a belt clip and a button clip adapter;

said belt clip selectively attaches to said button clip adapter by selectively inserting a portion of said button clip adapter into said belt clip and selectively holding a portion of said button clip adapter within said belt clip;

said belt clip comprises a holster and a clip;

said button clip adapter comprises a button and a clip;

said holster is configured to selectively receive said button of said button clip adapter;

said clip is configured to selectively attach to a portion of said beverage containment;

said button is held within said holster of said belt clip;

said clip is configured to selectively attach to said belt of said beverage holder;

thus, said belt clip selectively attaches to said belt, said button clip adapter selectively attaches to said beverage containment, and said beverage containment selectively holds said beverage;

said button clip adapter comprises said button and said clip;

said clip is configured to selectively attach to an upper rim portion of an upper retainer portion by clamping around a portion of said upper rim portion;

said clip comprises a C-shape comprising an angled face, a top portion, a back portion, a bottom portion and a lower front portion;

said clip derives its shape with an upper front portion attached to said top portion, said top portion attached to said back portion, said back portion attached to said bottom portion, and said bottom portion attached to said lower front portion, to wrap around with a gap between said upper front portion and said lower front portion; and a portion of said upper retainer portion selectively slides through said gap between said lower front portion and said upper front portion.

* * * * *